US006305090B1

(12) United States Patent
Julien

(10) Patent No.: US 6,305,090 B1
(45) Date of Patent: Oct. 23, 2001

(54) TILE TRACING APPARATUS AND METHOD

(75) Inventor: Rémi Julien, Lac Beauport (CA)

(73) Assignee: Claude Chabot, Les Saules (CA)

( * ) Notice: Subject to any disclaimer, the term of this patent is extended or adjusted under 35 U.S.C. 154(b) by 0 days.

(21) Appl. No.: 09/448,166

(22) Filed: Nov. 24, 1999

(30) Foreign Application Priority Data

Nov. 25, 1998 (CA) ..... 2254691

(51) Int. Cl.[7] ..... B43L 13/02
(52) U.S. Cl. ..... 33/41.5; 33/41.6; 33/526
(58) Field of Search ..... 33/41.5, 41.1, 33/20.1, 20.2, 41.6, 42, 526, 527, 32.1, 32.3

(56) References Cited

U.S. PATENT DOCUMENTS 37,650 * 2/1863 Van Horn ..... 33/41.5
2,588,757 * 3/1952 Peeples, Jr. ..... 33/41.6
2,726,451 * 12/1955 Johnson ..... 33/41.5
2,796,665 * 6/1957 Cossock ..... 33/41.5
4,665,619 * 5/1987 Pearl ..... 33/32.3

* cited by examiner

*Primary Examiner*—Christopher W. Fulton
(74) *Attorney, Agent, or Firm*—Collard & Roe, P.C.

(57) ABSTRACT

A tile marking apparatus for marking the contour of an object to be circumvented by a tile directly onto the tile including a base portion and a contour following rod is described. The contour following rod is so mounted to the base portion as to be laterally and longitudinally movable with respect to the base portion. The rod includes a distal end provided with a contour following tip and a proximate end provided with a pen. The distance separating the tip and the pen correspond to the dimensions of the side of a tile to be marked, and to that effect, the rod is preferably telescopically mounted in order to be adjustable. The tile to be marked is positioned above the tiles previously installed adjacent to the intended position and the base portion is positioned above the tile to be marked. The contour following tip may then follow the contour of the object to cause the pen to reproduce the contour directly onto the tile. A method to use the apparatus is also disclosed.

4 Claims, 6 Drawing Sheets

10
12
14
16
18
20
22
24
26
27
28
29
31
32
34
35
36
38
40
42
45
46
48
50
52
54
56
58
60
62
64
66
68
70
72
74
76
78
80
84
1
2

TILE TRACING APPARATUS AND METHOD

FIELD OF THE INVENTION

The present invention relates to tiles. More specifically, the present invention is concerned with a tile tracing apparatus and with a tile tracing method to reproduce, on a tile, lines representative of the layout of the floor where the tile is to be installed.

BACKGROUND OF THE INVENTION

Persons installing tiles on a floor are regularly challenged with the cutting of particular tiles to conform to the floor layout where the particular tile has to be installed.

The commonly accepted method used for cutting such tiles consists in taking manual measurements of the floor layout in the area where the tile is to be installed. These measurements are then transferred to a conventional tile, which is thus ready to be cut.

Of course, the method used to cut the tile varies with the type of tile used. For example, knives may be used to cut vinyl tiles while specially designed cutting assemblies are used to cut through encaustic and ceramic tiles.

The precision required to cut tiles is usually not of great importance since a quarter-round molding is usually installed over the tiles at the floor to wall joint. However, the manual measurement and the transfer of these measurements onto a tile often lead to the waste of a tile which has been improperly cut, which increases the overall cost of the floor covering.

Furthermore, the time required to take the measurements and to transfer these measurements onto the tile is usually quite long, which is another drawback of the manual measurement taking method.

SUMMARY OF THE INVENTION

An object of the present invention is therefore to provide a tile marking apparatus and a method therefor.

Another object of the invention is to provide a tile marking apparatus that is designed to transfer, directly onto a tile, the layout of the floor where the tile is to be installed, for most floor layouts.

In accordance with the invention, these objects are achieved with a tile tracing apparatus comprising:

- a frame assembly;
- a longitudinally movable assembly mounted to the frame assembly; and
- a laterally movable marking assembly mounted to the longitudinally movable assembly including a movable carriage and a contour following rod having a proximate end provided with a pen attachment device, to which a pen may be mounted, and a distal end provided with a contour following tip, said contour following rod being telescopically mounted to said movable carriage.

Other objects, advantages and features of the present invention will become more apparent upon reading of the following non-restrictive description of preferred embodiments thereof, given by way of example only with reference to the accompanying drawings.

DESCRIPTION OF PREFERRED EMBODIMENTS OF THE INVENTION

Figure 1:
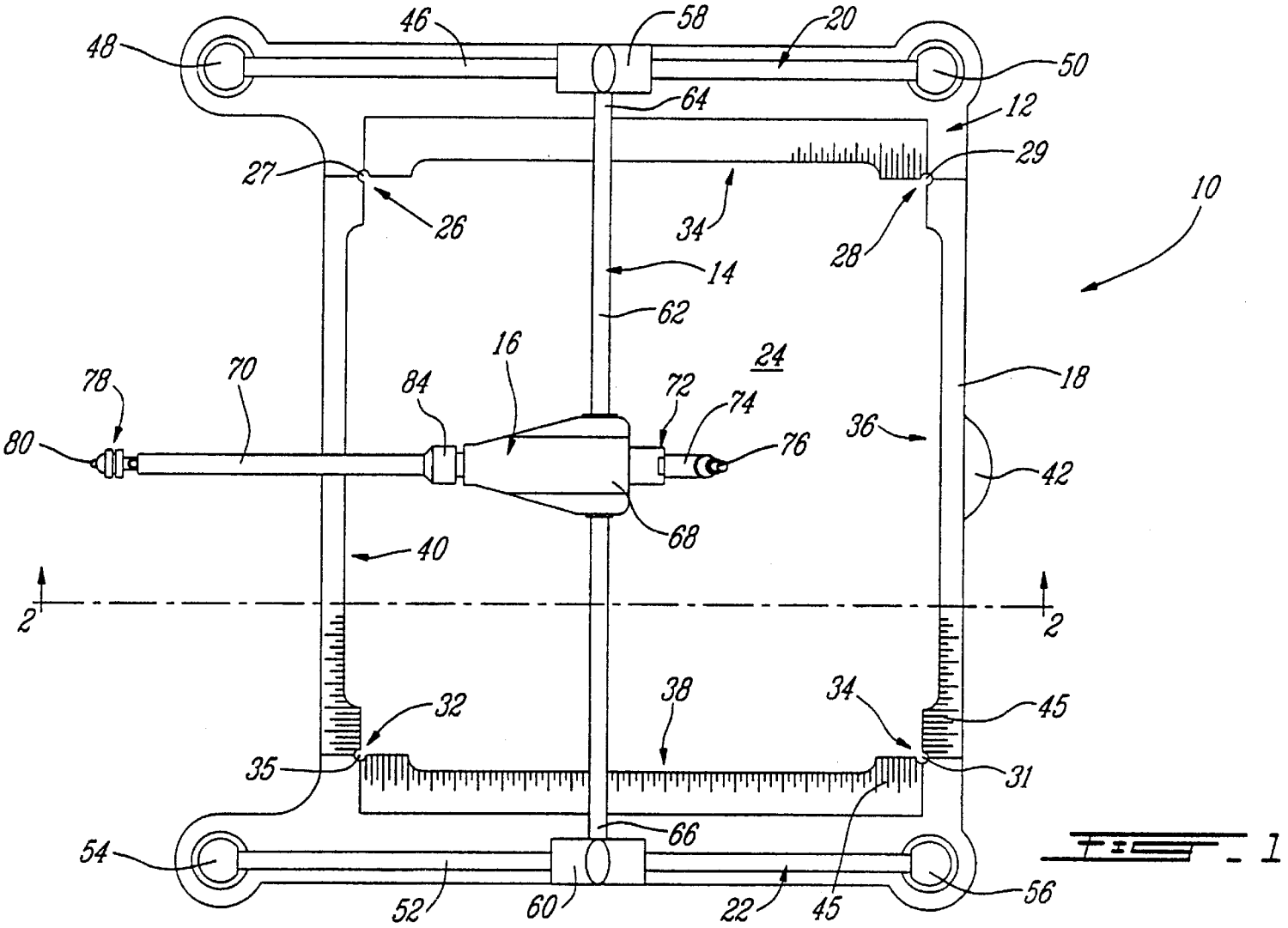
FIG. 1 is a top plan view of a tile marking apparatus according to an embodiment of the present invention.
Figure 2:
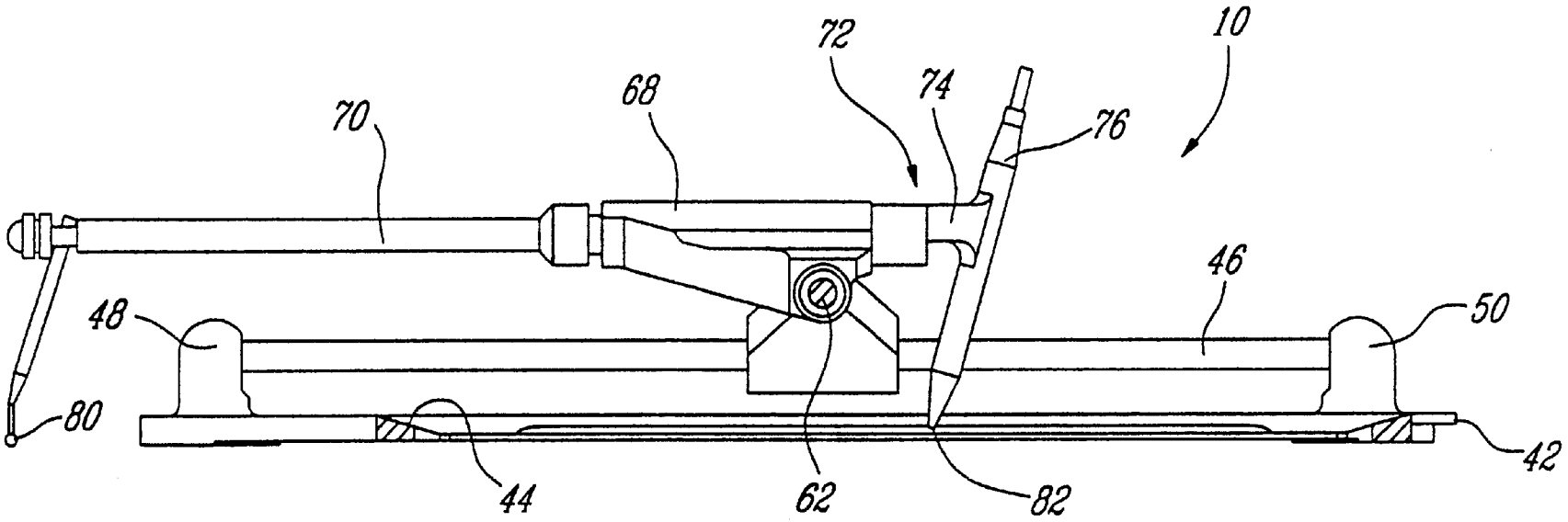
FIG. 2 is a sectional view taken along line 2—2 of FIG. 1.

Turning now to FIGS. 1 and 2 of the appended drawings, a tile marking apparatus 10 according to a preferred embodiment of the present invention will be described.

The tile marking apparatus 10 includes a frame assembly 12, a longitudinally movable assembly 14 mounted to the frame assembly 12 and a laterally movable marking assembly 16 mounted to the longitudinally movable assembly 14.

The frame assembly 12 includes a generally rectangular base 18 having internal dimensions configured and sized to receive a conventional tile having predetermined dimensions, and a pair of lateral guides 20, 22.

The generally rectangular base 18 includes an aperture 24 having four right angle corners 26, 28, 32 and 34, and a handle 42. As can be better seen from FIG. 2, the sides of the aperture 24 define sloping surfaces, for example 44. These surfaces are provided with dimension markings 45.

Each right angle corner 26, 28, 32 and 34 is provided with a respective semi-circular cutout portion 27, 29, 31 and 35 facilitating the precise positioning of the apparatus 10 onto a tile to be marked.

As will be described hereinafter, the dimensions of the square figure defined by the internal edges of the right angle corners 26, 28, 32 and 34 is advantageously generally similar to the dimensions of a tile to be marked by the apparatus 10.

The lateral guide 20 includes a cylindrical sliding rod 46 and a pair of rod mounting elements 48, 50 mounting the rod 46 to the base 18. Similarly, the lateral guide 22 includes a cylindrical sliding rod 52 and a pair of rod mounting elements 54, 56 mounting the rod 52 to the base 18.

The longitudinally movable assembly 14 includes first and second movable elements 58, 60 each including a central aperture (not shown) allowing the elements 58, 60 to be slidably mounted to respective cylindrical sliding rod 46 and 52 through ball bearings (not shown) or other friction reducing material (not shown).

The longitudinally movable assembly 14 also includes a transversal cylindrical rod 62 provided with a first end 64 mounted in an aperture of the movable element 58 and a second end 66 mounted in an aperture of the movable element 60.

The laterally movable assembly 16 includes a movable carriage 68 and a contour following rod 70 having a proximate end 72 provided with a pen attachment device 74, to which a pen 76 may be mounted, and a distal end 78 provided with a contour following tip 80. In a preferred embodiment, as better shown in FIG. 2, the tip 80 is preferably even with or ahead of the distal end 78, so that the distal end 78 does not interfere with any obstacles while using the apparatus.

As will be further described hereinbelow, the distance separating the tip 80 and the point 82 (see FIG. 2) of the pen 76 is essentially the dimension of the side of a tile to be marked by the apparatus 10.

The movable carriage 68 includes a lateral aperture (not shown) allowing the carriage 68 to be slidably mounted to the cylindrical rod 62 through ball bearings (not shown).

The movable carriage 68 further includes a longitudinal aperture (not shown) to receive the contour following rod 70 therein. The contour following rod 70 is maintained in a fixed relationship with the carriage 68 through a securing element 84.

Figure 5:
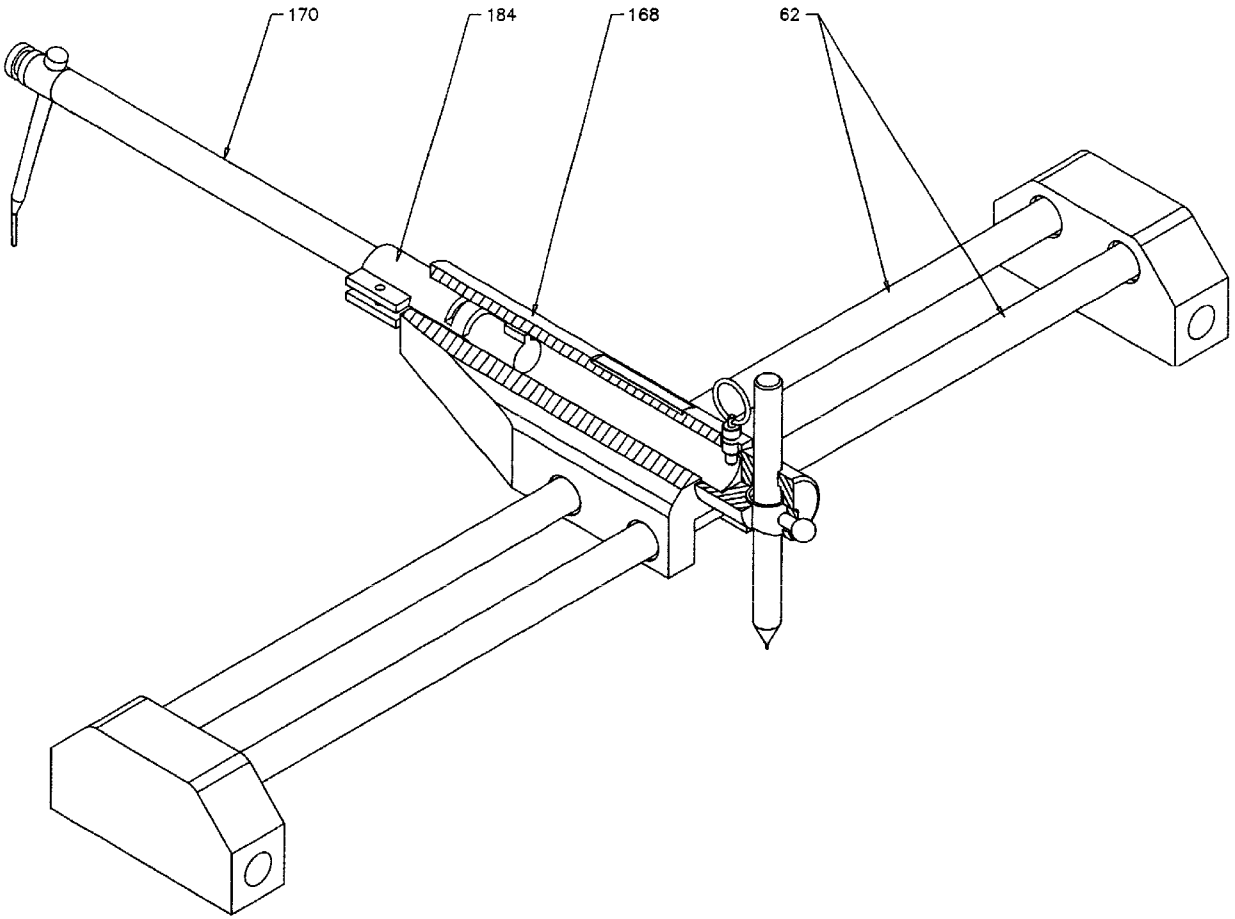
FIG. 5 is a perspective view of an alternative embodiment of the carriage and rod of the tile marking apparatus of the present invention.
Figure 6:
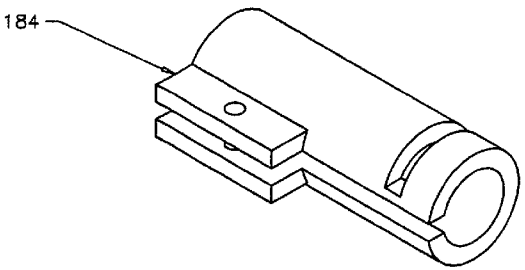
FIG. 6 is a perspective view of the collar for use with the embodiment of FIG. 5.
Figure 7:
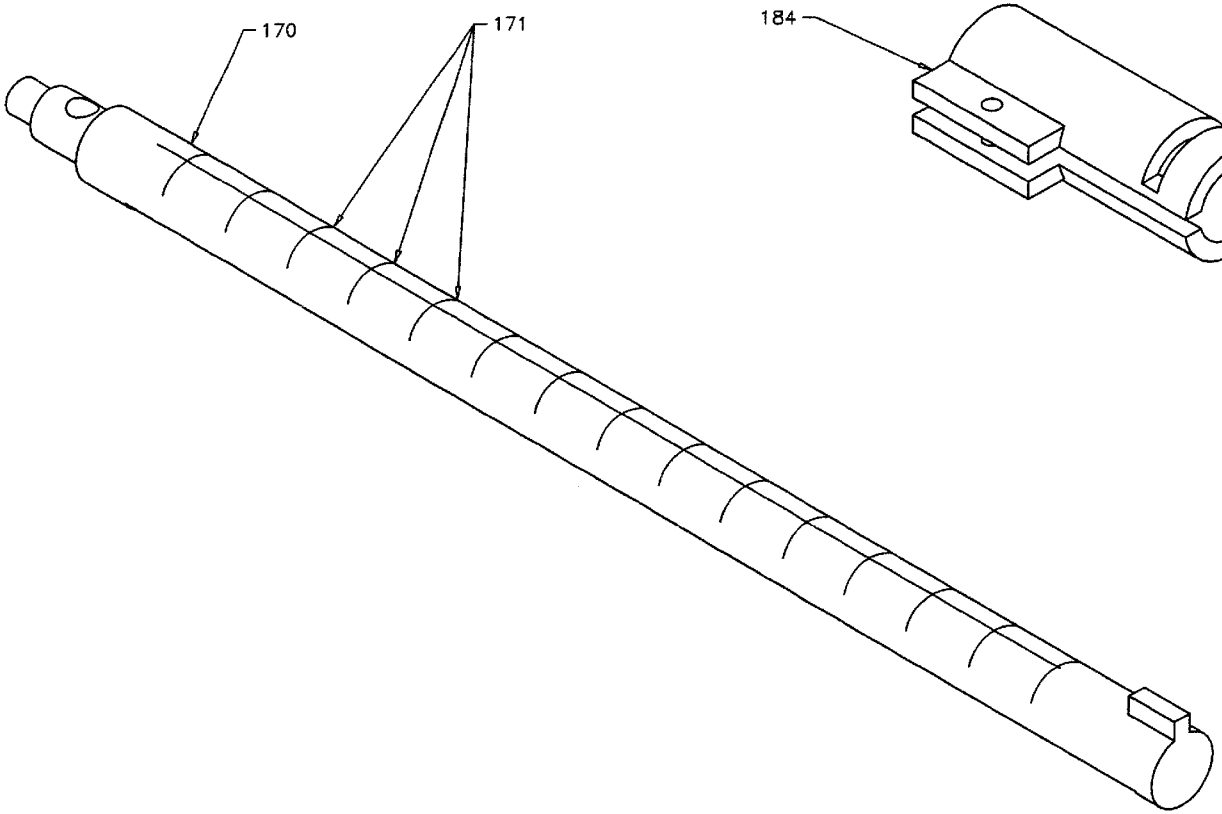
FIG. 7 is a perspective view of the notched rod of FIG. 5.

Referring now to FIGS. 5, 6 and 7, there is shown an alternative embodiment of the carriage 168, the following rod 170 and the securing element 184.

In order to provide enhanced stability of the apparatus of the invention, the movable elements 58 and 60 are preferably provided with two openings each, in order to receive two, parallel rods 62 and 62'. To that effect, carriage 168 is thus further provided with two openings for receiving the rods 62 and 62' (see FIG. 5).

Although the apparatus was originally designed for a predetermined tile size, it is apparent that the apparatus can be adjusted to fit any tile, whatever the size may be. As mentioned previously, the distance separating the tip 80 and the point 82 of the pen 76 is essentially the dimension of the side of a tile to be marked by the apparatus. Consequently, if different tiles should be marked, the rod 70 must be adjustable to that effect. In a preferred embodiment of the invention, securing element 184 is an open collar (see FIG. 6), for releasably securing rod 170. Thus, rod 170 is telescopically engaged in collar 184, and is preferably provided with notches 171 for standard lengths (see FIG. 7). Consequently, by inserting or extracting rod 170 from carriage 168 and securing it with collar 184, the apparatus 10 of the present invention can be used to mark tiles of any size, provided the tiles have a size which is comprised between the longest and shortest lengths of rod 170 (i.e. how short can the distance be to how long can the distance be).

Figure 3:
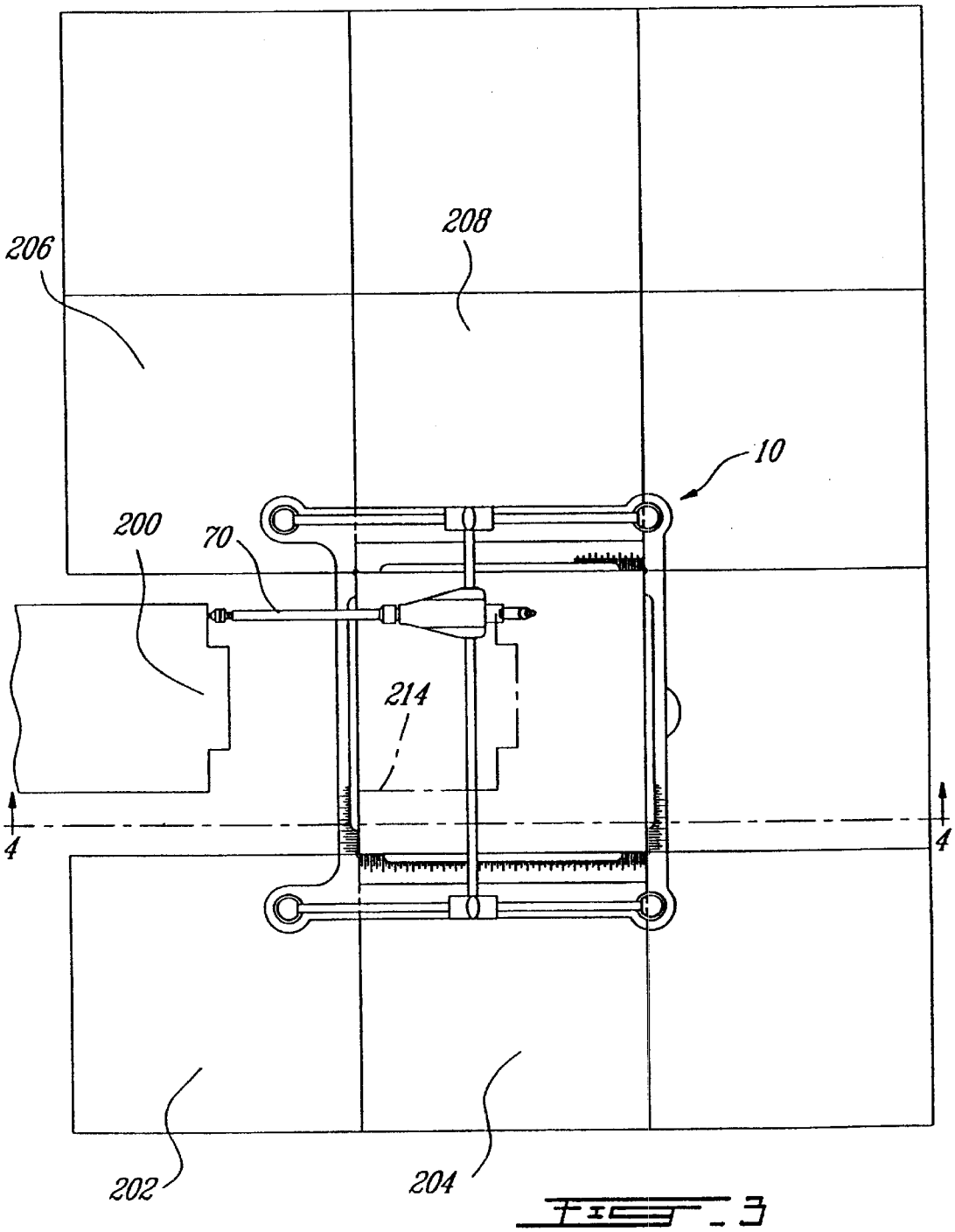
FIG. 3 is a top plan view of the tile marking apparatus of FIG. 1 illustrated in operation onto a vinyl tile.
Figure 4:
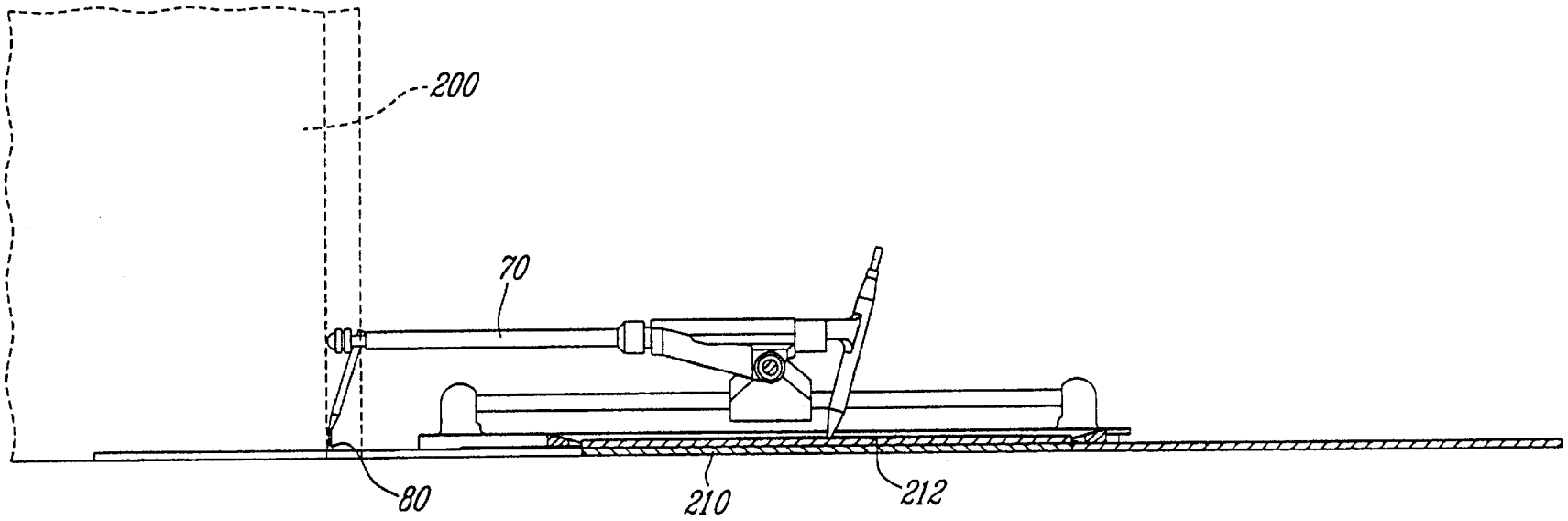
FIG. 4 is a sectional view taken along line 4—4 of FIG. 1.

Turning now to FIGS. 3 and 4 of the appended drawings, the operation of the tile marking apparatus 10 will be described. In the following description of the operation of the invention, the term "marked tile" is intended to define the tile being marked by the apparatus 10 and the term "adjacent tile" is intended to define the tile adjacent to the marked tile, where the apparatus 10 is positioned.

In the example of use illustrated in FIGS. 3 and 4, a door frame 200 is so positioned that a specially cut tile provided with an adequate cutout must be installed.

To operate the apparatus 10 to mark a tile for subsequent installation, the user simply has to execute the following steps:

1- conventionally installing the tiles adjacent to the position where a specially cut tile must be installed (in the example of FIGS. 3 and 4, these are tiles 202, 204, 206, 208 and the adjacent tile 208 shown in FIG. 4);

2- positioning a tile, the marked tile 212, in an overlapping relationship with the adjacent tile 210;

3- positioning the apparatus 10 in an overlapping relationship with the marked tile 212 so that the comers of the tile 212 are registered with the right angle corners 26, 28, 30 and 32; and 4- following the contour of the door frame 200 with the contour following tip 80.

The above steps defining a method for making tiles for subsequent cutting.

The contour of the door frame 200 is therefore partially reproduced onto the marked tile 212. The user then simply has to manually finish the lines (see for example the dashed-dotted line 214 of FIG. 3) that the pen could not mark onto the tile 212 since the contour following tip 80 could not follow the corresponding contour line of the door frame 200. It is however to be noted that to manually mark these lines, the user does not have to take measurements.

When all the lines are properly marked onto the marked tile 212, the user may cut the tile along these lines and install the tile 212 at its intended position in a conventional manner.

It is to be noted that the undersurface of the base 18 could be made of a friction increasing material to prevent apparatus motions while in use.

It is also to be noted that the pen 76 could be replaced by a hard pointed tip to engrave the lines instead of marking them.

It is to be noted that the example of FIGS. 3 and 4 relates to the marking and the cutting of a vinyl or similar tile. For tiles that are usually installed with a joint separating adjacent tiles, for example ceramic tiles separated by a mortar joint, the distance between the contour following tip 80 and the tip 82 of the pen 76 would be the dimension of a side of the tile plus the width of the mortar joint. Also, if an apparatus similar to the apparatus 10 is designed to trace onto tiles that are usually installed with a joint separating adjacent tiles, the base 18 could advantageously be provided with downwardly extending pointed feet (not shown) preventing the underside of the base 18 from contacting the mortar joints and becoming soiled.

Although the present invention has been described hereinabove by way of preferred embodiments thereof, it can be modified, without departing from the spirit and nature of the subject invention as defined in the appended claims.

What is claimed is:

1. A tile marking apparatus comprising:

a frame assembly;

a longitudinally movable assembly mounted to the frame assembly; and a laterally movable marking assembly mounted to the longitudinally movable assembly; said laterally movable assembly including a movable carriage and a contour following rod having a proximate end provided with a pen attachment device, to which a pen may be mounted, and a distal end provided with a contour following tip, said contour following rod being telescopically mounted to said movable carriage.

2. A tile marking apparatus according to claim 1, wherein said frame assembly includes a substantially rectangular base and a pair of lateral guides, each lateral guide including a cylindrical sliding rod and a pair of rod mounting elements for mounting each rod to the base.

3. A tile marking apparatus according to claim 1, wherein said longitudinally movable assembly includes first and second movable elements, each including a central aperture for slidably receiving a cylindrical sliding rod, respectively; and wherein said longitudinally movable assembly includes at least one transversal cylindrical rod provided with opposite ends mounted in an aperture of a respective movable element.

4. A method for marking a tile for subsequent cutting comprising the steps of:

conventionally installing tiles adjacent to the position where the tile must be installed;

positioning the tile to be marked, in an overlapping relationship with one of said adjacent tiles;

positioning an apparatus in an overlapping relationship with the tile to be marked so that corners of the tile are in register with internal edges of a positioning arrangement of the apparatus; and following the contour of an object with a contour following tip of said apparatus.

* * * * *